US007080938B1

(12) United States Patent
Moore et al.

(10) Patent No.: US 7,080,938 B1
(45) Date of Patent: Jul. 25, 2006

(54) WATCH APPARATUS

(76) Inventors: Quentin Moore, 4751 McClellan, Detroit, MI (US) 48214; Videle Dixon, 4751 McClellan, Detroit, MI (US) 48214; George S. Smith, 11450 Flanders St., Detroit, MI (US) 48205

( * ) Notice: Subject to any disclaimer, the term of this patent is extended or adjusted under 35 U.S.C. 154(b) by 0 days.

(21) Appl. No.: 10/934,161

(22) Filed: Sep. 7, 2004

(51) Int. Cl.
*G04B 37/00* (2006.01)

(52) U.S. Cl. ..... 368/295; 368/10; 368/11

(58) Field of Classification Search ..... 368/10, 368/11, 281, 283, 294, 295
See application file for complete search history.

(56) References Cited

U.S. PATENT DOCUMENTS

| | | | | |
|---|---|---|---|---|
| 272,310 | A | 12/1883 | Palmer | |
| 3,271,945 | A | 9/1966 | Anderson | |
| 4,815,053 | A | 3/1989 | Dal Busco | |
| 4,975,893 | A | 12/1990 | Dal Busco | |
| 5,822,279 | A * | 10/1998 | Cuche et al. | 368/295 |
| D401,861 | S | 12/1998 | Riley | |
| D415,693 | S | 10/1999 | Kennedy | |
| 6,164,814 | A | 12/2000 | Crow | |
| 6,599,009 | B1 * | 7/2003 | Terasawa et al. | 368/295 |

* cited by examiner

*Primary Examiner*—Kamand Cuneo
*Assistant Examiner*—Thanh S. Phan

(57) ABSTRACT

A watch apparatus includes a wristwatch that includes a watch housing with a face, a back side and a peripheral edge. A wristband is attached to the peripheral edge. A bezel is rotatably mounted to the watch housing and extends around the face. A motor is mounted on the peripheral wall of the watch housing. A gear assembly is mechanically coupled to the motor. The motor is adapted for rotating the gear assembly. The gear assembly is in communication with the bezel so that the bezel rotates when the motor is turned on. A processor is electrically coupled to the motor. A heat sensor is mounted on the back side and is electrically coupled to the processor. The processor turns on the motor when the heat sensor detects heat above 80 degrees. The processor turns off the motor when the heat sensor detects a temperature less than 80 degrees.

4 Claims, 2 Drawing Sheets

WATCH APPARATUS

BACKGROUND OF THE INVENTION

1. Field of the Invention

The present invention relates to wristwatch devices and more particularly pertains to a new wristwatch device that provides for a rotating bezel which automatically rotates when placed against a wrist.

2. Description of the Prior Art

The use of wristwatch devices is known in the prior art. U.S. Pat. No. 4,815,053 describes a wristwatch having a bezel which can be rotated by hand and which is adapted for easy removal and replacement. A similar device is found in U.S. Pat. No. 6,164,814 which has a rotatable bezel with a fob attached thereto for allowing a user to easily rotate the bezel for improved viewing of the watch. Yet another such device is U.S. Pat. No. 3,271,945 that again includes a conventional wristwatch having a bezel that may be selectively rotated by hand.

While these devices fulfill their respective, particular objectives and requirements, the need remains for a wristwatch having a bezel that rotates automatically. Such rotation will enhance the aesthetics of the wristwatch, particularly if the bezel has faceting therein or includes gemstones mounted thereon. It is preferred that such a bezel only rotates when the wristwatch is being worn to prevent the depletion of the wristwatch's power supply.

SUMMARY OF THE INVENTION

The present invention meets the needs presented above by generally comprising a wristwatch that includes a watch housing. The watch housing has a face, a back side and a peripheral edge. A wristband is attached to the peripheral edge of the watch housing. A bezel is rotatably mounted to the watch housing and extends around the face. A motor is mounted on the peripheral wall of the watch housing. A gear assembly is mechanically coupled to the motor. The motor is adapted for rotating the gear assembly. The gear assembly is in communication with the bezel so that the bezel rotates when the motor is turned on. A processor is electrically coupled to the motor. A heat sensor is mounted on the back side of the watch housing and is electrically coupled to the processor. The processor turns on the motor when the heat sensor detects heat above 80 degrees. The processor turns off the motor when the heat sensor detects a temperature less than 80 degrees.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
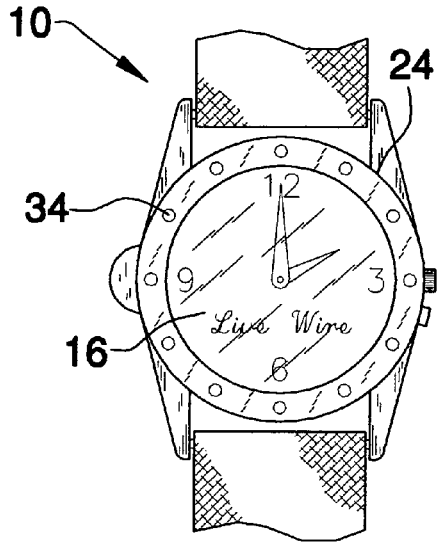
FIG. 1 is a front view of a watch apparatus according to the present invention.
Figure 2:
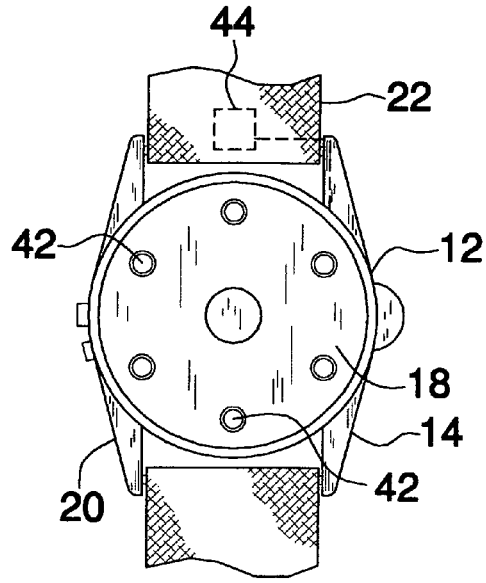
FIG. 2 is a back view of the present invention.
Figure 3:
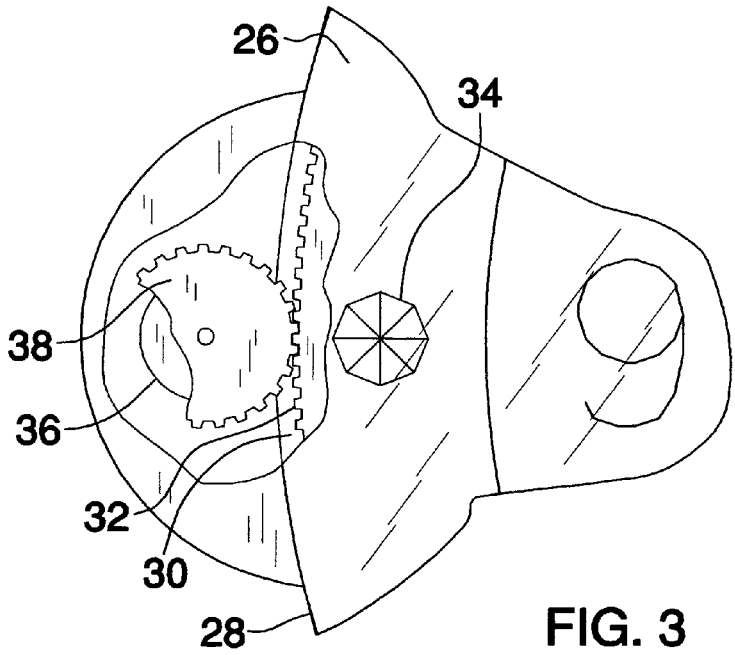
FIG. 3 is a broken front view of the present invention.
Figure 4:
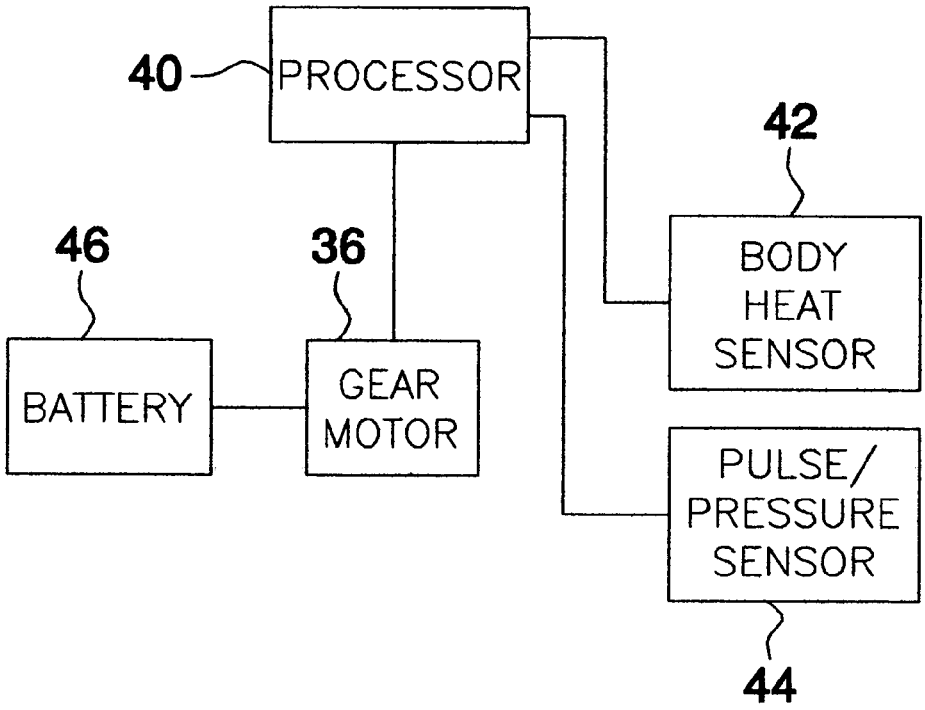
FIG. 4 is an electronic schematic view of the present invention.

With reference now to the drawings, and in particular to FIGS. 1 through 4 thereof, a new wristwatch device embodying the principles and concepts of the present invention and generally designated by the reference numeral 10 will be described.

As best illustrated in FIGS. 1 through 4, the watch apparatus 10 generally comprises a wristwatch 12 that includes a watch housing 14 with a face 16, a back side 18 and a peripheral edge 20. The wristwatch 12 is generally conventional and may include digital or analog time keeping. A wristband 22 is attached to the peripheral edge 20 of the watch housing 14. The wristband 22 may include any conventional wristband typically used with wristwatches.

A bezel 24 is rotatably mounted to the watch housing 14 and extends around the face 16. The bezel 24 has an upper surface 26 and a perimeter edge 28. The perimeter edge 28 has a peripheral slot 30 therein. Teeth 32 are positioned in the slot 30. A plurality of gems 34 is preferably mounted in the upper surface 26 of the bezel 24. The gems 34 are ideally diamonds though any precious or semi-precious gems may also be used.

A motor 36 is mounted on the peripheral wall 20 of the watch housing 14. A gear assembly is mechanically coupled to the motor 36. The motor 36 is adapted for rotating the gear assembly. The gear assembly, and in particular a bezel actuating gear 38, is in communication with the teeth 32 on the bezel 24 so that the bezel 24 rotates when the motor 36 is turned on.

A processor 40 is electrically coupled to the motor 36. The processor 40 may include any conventional micro-switch, microprocessor or circuit that is adapted for receiving an input and in turn turning on the motor 36 based upon the input received. A heat sensor 42 is mounted on the back side 18 of the watch housing 14 and may include a plurality of heat sensing pads. The heat sensor(s) 42 is electrically coupled to the processor 40. The processor 40 turns on the motor 36 when the heat sensor 42 detects heat above 80 degrees. A pulse sensor 44 adapted for detecting a human pulse is electrically coupled to the processor. The pulse sensor 44 is preferably positioned in the wristband. The processor 40 turns on the motor 36 when the pulse sensor 44 detects a pulse. Alternatively, the pulse sensor 44 may comprise a pressure detector adapted for detecting pressure placed against the wristband.

In use, when a person places the watch housing 14 on their wrist, the heat sensor 42 and/or the pulse detector 44 will detect wearer's pulse and heat. This signal is transferred to the processor 40, which turns on the motor 36 to cause the bezel 24 to rotate. The processor 40 will turn off the motor 36 when the heat sensor 42 detects a temperature less than 80 degrees and the pulse sensor 44 does not detect a pulse. This will save on the life of a battery 46 or other power source which powers the motor 36 and may also be used to power the wristwatch 12 itself.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A watch assembly comprising:

a wristwatch including a watch housing, said watch housing having a face, a back side and a peripheral edge;

a wristband being attached to said peripheral edge of said watch housing;

a bezel being rotatably mounted to said watch housing and extending around said face;

a motor being mounted on said peripheral wall of said watch housing, a gear assembly being mechanically coupled to said motor, said motor being adapted for rotating said gear assembly, said gear assembly being in communication with said bezel such that said bezel rotates when said motor is turned on;

a processor being electrically coupled to said motor;

a heat sensor being mounted on said back side of said watch housing, said heat sensor being electrically coupled to said processor, said processor turning on said motor when said heat sensor detects heat above 80 degrees; and wherein said processor turns off said motor when said heat sensor detects a temperature less than 80 degrees.

2. The watch assembly according to claim 1, wherein further including a pulse sensor adapted for detecting a human pulse being electrically coupled to said processor, said pulse sensor being positioned in said wristband, said processor turning on said motor when said pulse sensor detects a pulse, wherein said processor turns off said motor when said heat sensor detects a temperature less than 80 degrees and said pulse sensor does not detect a pulse.

3. The watch assembly according to claim 2, wherein said bezel has an upper surface, a plurality of gems being mounted on said upper surface.

4. A watch assembly comprising:

a wristwatch including a watch housing, said watch housing having a face, a back side and a peripheral edge;

a wristband being attached to said peripheral edge of said watch housing;

a bezel being rotatably mounted to said watch housing and extending around said face;

a motor being mounted on said peripheral wall of said watch housing, a gear assembly being mechanically coupled to said motor, said motor being adapted for rotating said gear assembly, said gear assembly being in communication with said bezel such that said bezel rotates when said motor is turned on;

a processor being electrically coupled to said motor;

a pulse sensor adapted for detecting a human pulse being electrically coupled to said processor, said pulse sensor being positioned in said wristband, said processor turning on said motor when said pulse sensor detects a pulse, wherein said processor turns off said motor when said pulse sensor does not detect a pulse.

* * * * *

UNITED STATES PATENT AND TRADEMARK OFFICE

CERTIFICATE OF CORRECTION

PATENT NO. : 7,080,938 B1
APPLICATION NO. : 10/934161
DATED : July 25, 2006
INVENTOR(S) : Moore et al.

It is certified that error appears in the above-identified patent and that said Letters Patent is hereby corrected as shown below:

On the title page (76), delete the inventor George S. Smith.

Signed and Sealed this

Second Day of January, 2007

JON W. DUDAS
*Director of the United States Patent and Trademark Office*